US010161270B2

(12) United States Patent
Hunter et al.

(10) Patent No.: US 10,161,270 B2
(45) Date of Patent: Dec. 25, 2018

(54) RANKINE CYCLE PUMP AND RECUPERATOR DESIGN FOR MULTIPLE BOILER SYSTEMS

(71) Applicant: AVL Powertrain Engineering, Inc., Plymouth, MI (US)

(72) Inventors: Gary L. Hunter, Brighton, MI (US); Gustav R. Johnson, Canton, MI (US); Nicholas Michael Zayan, Fenton, MI (US)

(73) Assignee: AVL POWERTRAIN ENGINEERING, INC., Plymouth, MI (US)

( * ) Notice: Subject to any disclaimer, the term of this patent is extended or adjusted under 35 U.S.C. 154(b) by 105 days.

(21) Appl. No.: 15/245,915

(22) Filed: Aug. 24, 2016

(65) Prior Publication Data

US 2017/0067371 A1 Mar. 9, 2017

Related U.S. Application Data

(60) Provisional application No. 62/213,675, filed on Sep. 3, 2015.

(51) Int. Cl.

| | |
|---|---|
| ***F01K 23/10*** | (2006.01) |
| ***F01K 7/16*** | (2006.01) |
| ***F01K 23/06*** | (2006.01) |

(52) U.S. Cl.

CPC ..... *F01K 23/101* (2013.01); *F01K 7/165* (2013.01); *F01K 23/065* (2013.01)

(58) Field of Classification Search

CPC ..... F01K 23/101; F01K 23/065; F01K 7/165
USPC ..... 60/614, 616, 618, 641.1–641.15
See application file for complete search history.

(56) References Cited

U.S. PATENT DOCUMENTS 4,120,157 A * 10/1978 Tang ..... F01K 23/14 60/618
4,122,680 A * 10/1978 Isshiki ..... F01K 5/00 60/649
5,272,879 A * 12/1993 Wiggs ..... F01K 25/08 165/45
9,074,492 B2 * 7/2015 Uzkan ..... F01K 13/00
(Continued)

FOREIGN PATENT DOCUMENTS

EP 2604814 A1 6/2013

OTHER PUBLICATIONS

Collings, P.; Yu, Z. Modelling and Analysis of a Small-Scale Organic Rankine Cycle System with a Scroll Expander. Proceedings of the World Congress on Engineering 2014. vol. II. Jul. 2-4, London, U.K. (6 Pages).

*Primary Examiner* — Hoang Nguyen
(74) *Attorney, Agent, or Firm* — Harness, Dickey & Pierce, P.L.C.

(57) ABSTRACT

A waste heat recovery system for an engine is disclosed. In one example, the waste heat recovery system includes an expander, a first heat exchanger system, and a second heat exchanger system. The expander is configured to convert waste heat from a working fluid into mechanical energy. The first heat exchanger system is in fluid communication with the expander, the first heat exchanger system disposed upstream of the expander. The second heat exchanger system is in fluid communication with the expander and is disposed upstream of the expander and arranged in parallel with the first heat exchanger system.

20 Claims, 3 Drawing Sheets

(56) References Cited

U.S. PATENT DOCUMENTS

| | | | | |
|---|---|---|---|---|
| 2005/0183440 | A1* | 8/2005 | Holtzapple | B01D 1/0058 62/333 |
| 2012/0042650 | A1* | 2/2012 | Ernst | F01K 13/02 60/615 |
| 2014/0183957 | A1* | 7/2014 | Duchesneau | F01K 13/006 307/64 |
| 2015/0276283 | A1* | 10/2015 | Waibel | F25B 39/028 62/56 |

* cited by examiner

RANKINE CYCLE PUMP AND RECUPERATOR DESIGN FOR MULTIPLE BOILER SYSTEMS

CROSS-REFERENCE TO RELATED APPLICATIONS

The present disclosure claims the benefit of U.S. Provisional Application No. 62/213,675, filed on Sep. 3, 2015. The entire disclosure of the application referenced above is incorporated herein by reference.

FIELD

The present disclosure relates to a Rankine Cycle pump and recuperator having multiple heat sources or boiler systems, and more particularly to a closed cycle waste heat recovery system utilizing more than one heat source.

BACKGROUND

This section provides background information related to the present disclosure which is not necessarily prior art.

The Rankine Cycle is a thermodynamic cycle that utilizes a heat source and working fluid to convert the heat produced by the heat source into mechanical work performed by the working fluid. Various types of heat sources or boilers can be utilized in a Rankine Cycle system. For example, residual or waste heat produced by in an industrial process or other operation, and released in the form of exhaust gases, can be effectively utilized in a Rankine Cycle system. In one particular example of a waste heat recovery system, waste heat in the form of exhaust gases produced by an internal combustion engine can be utilized in a Ranking Cycle system and converted into mechanical work in order to improve the efficiency of the internal combustion engine. In some applications, a device or process may produce more than one heat source.

While known Rankine Cycle and waste hear recovery systems have generally proven to be acceptable for their intended purposes, a continued need in the relevant art remains for a system that effectively and efficiently utilizes heat produced by multiple heat sources.

SUMMARY

This section provides a general summary of the disclosure, and is not a comprehensive disclosure of its full scope or all of its features.

A waste heat recovery system for an engine is disclosed. In one example, the waste heat recovery system includes an expander, a first heat exchanger system, and a second heat exchanger system. The expander is configured to convert waste heat from a working fluid into mechanical energy. The first heat exchanger system is in fluid communication with the expander, the first heat exchanger system disposed upstream of the expander. The second heat exchanger system is in fluid communication with the expander and is disposed upstream of the expander and arranged in parallel with the first heat exchanger system.

A method for operating a waste heat recovery system is also disclosed. The waste heat recovery system has first and second heat exchanger systems in fluid communication with an expander. In one example, the method includes determining a first actual flow characteristic of a working fluid flowing through the first heat exchanger system and determining a second actual flow characteristic of the working fluid flowing through the second heat exchanger system. The example method also includes determining a first desired flow characteristic of the working fluid flowing through the first heat exchanger system and determining a second desired flow characteristic of the working fluid flowing through the second heat exchanger system. The example method further includes comparing the first actual flow characteristic to the first desired flow characteristic, comparing the second actual flow characteristic to the second desired flow characteristic, and adjusting at least one of a pump speed and a valve position based on at least one of the comparison of the first actual flow characteristic to the first desired flow characteristic and the comparison of the second actual flow characteristic to the second desired flow characteristic.

A system for controlling a waste heat recovery system is also disclosed. In one example, the system includes a desired characteristic module and at least one of a pump control module and a valve control module. The desired characteristic module determines a desired value of a flow characteristic of a working fluid flowing through first and second heat exchanger systems of a Rankine cycle system. Based on the desired value, the pump control module selectively changes the speed of at least one of a first pump disposed in the first heat exchanger system and a second pump disposed in the second heat exchanger system. Also, based on the desired value, the valve control module selectively adjusts the position of at least one of a first valve disposed in the first heat exchanger system and a second valve disposed in the second heat exchanger system.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
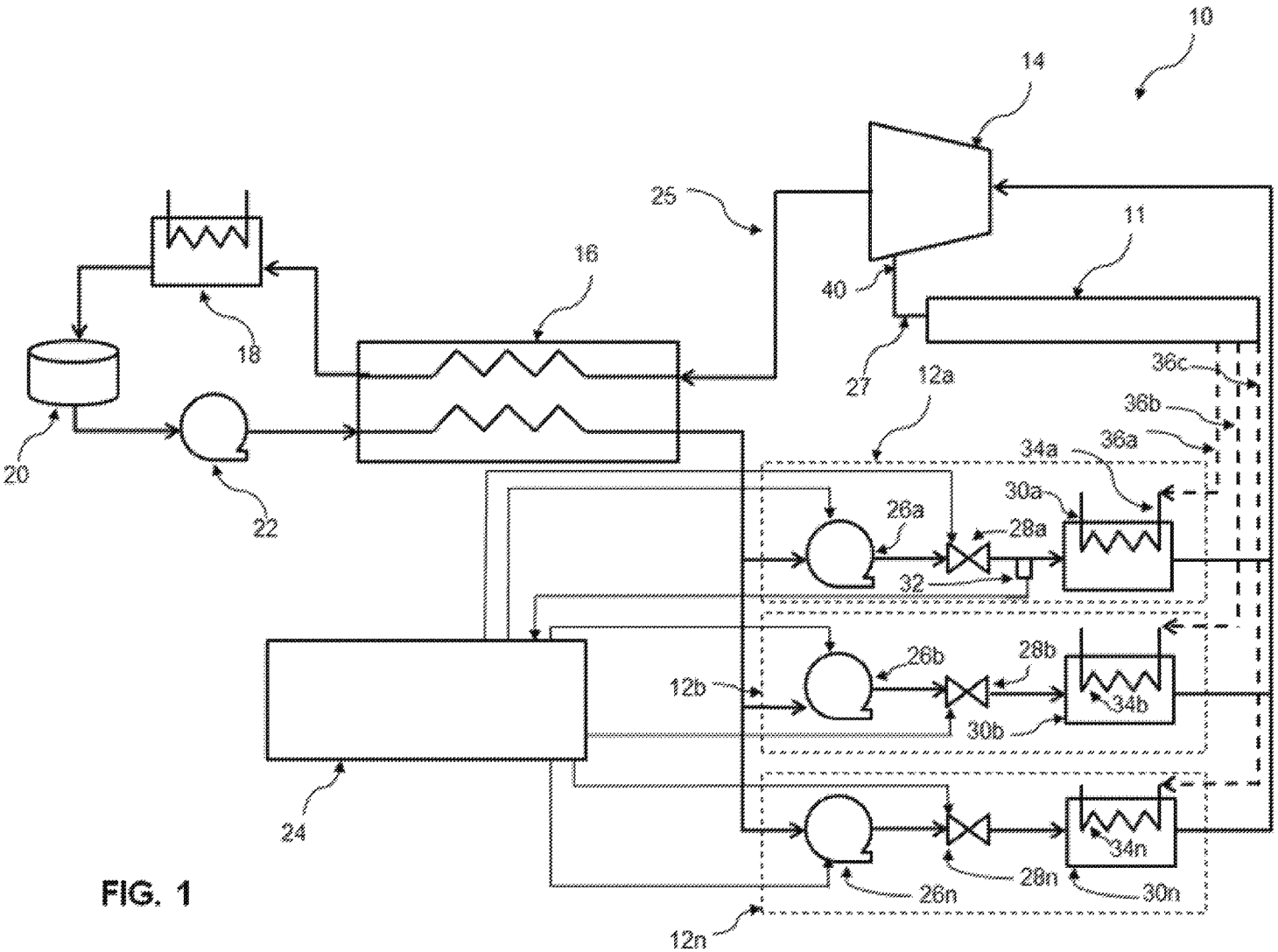
FIG. 1 is a functional block diagram of an example Rankine Cycle system according to the principles of the present disclosure.

With reference to FIG. 1, a Rankine Cycle system 10 is shown. In some configurations, the Rankine Cycle system 10 may be a waste heat recovery (WHR) system. In this regard, in some configurations, the Rankine Cycle system 10 may be configured to recover residual heat from exhaust gases produced by an industrial process or other operation. In one configuration, the Rankine Cycle system 10 may be configured to recover residual heat from exhaust gases produced by an internal combustion engine 11 in a motor vehicle (not shown).

The system 10 may include one or more heat exchanger systems 12, an expander 14, a recuperator 16, a heat exchanger or condenser 18, a working fluid reservoir 20, a lift pump 22, and a system control module 24. The system 10 may define a closed loop system having a flowpath 25 for circulating a working fluid (e.g., carbon dioxide, nitrogen, or any other suitable fluid), such that the working fluid may circulate through the system 10 without contacting or communicating with the surrounding environment. In this regard, as will be described in more detail below, the flowpath 25 may define a continuous loop from the heat exchanger systems 12 to the expander 14, from the expander 14 to the recuperator 16, from the recuperator 16 to the condenser 18, from the condenser 18 to the reservoir 20, from the reservoir 20 to the lift pump 22, from the lift pump 22 to the recuperator 16, and from the recuperator 16 back to the heat exchanger systems 12. As the working fluid circulates about the flowpath 25 through the system 10, the heat exchanger systems 12 can recover energy from the waste heat produced by the engine 11, or other industrial process or device. The expander 14 can convert the energy recovered from the waste heat into another form of energy (e.g., kinetic energy), which can be used to support the engine 11, or other industrial process or device. For example, in one configuration, the energy converted and produced by the expander 14 can be used to drive a crankshaft 27 in the engine 11, and thereby improve the efficiency and performance of the engine 11.

As illustrated, the system 10 may include more than one heat exchanger system 12. In this regard, the system 10 may include any number "n" of heat exchanger systems 12. For example, in one configuration the system 10 includes a first heat exchanger system 12*a* and a second heat exchanger system 12*b*. It will be appreciated, however, that the system 10 may include more than two heat exchanger systems 12. As illustrated, the heat exchanger systems 12 can be arranged in parallel, such that working fluid exiting the recuperator 16 flows into the first heat exchanger system 12*a*, the second heat exchanger system 12*b*, and any other number of heat exchanger systems 12*n*. Moreover, working fluid exiting the first heat exchanger system 12*a*, the second heat exchanger system 12*b*, and any other number of heat exchanger systems 12*n*, can flow into, or otherwise enter the expander 14.

Each heat exchanger system 12 may include a pump 26, a valve 28, a heat exchanger 30, and one or more sensors 32. The sensor 32 may be configured to measure, and communicate to the system control module 24, one or more characteristics of the working fluid flowing through the heat exchanger system 12. In this regard, while the sensor 32 is illustrated as being located downstream of the valve 28 and upstream of the heat exchanger 30, it will be appreciated that one or more of the sensor(s) 32 may be in other locations within the heat exchanger system 12 within the scope of the present disclosure. For example, the sensor 32 may be located and configured to measure and communicate characteristic(s) such as the volumetric or mass flow rate, temperature, pressure, etc. of the working fluid flowing through the heat exchanger system 12. While only the first heat exchanger system 12*a* is shown to include the sensor 32, it will be appreciated that each of the heat exchanger systems 12 may similarly include one or more of the sensor(s) 32.

As illustrated, the pump 26 is in fluid communication with the recuperator 16. In particular, the pump 26 can cause the working fluid to flow through the heat exchanger 30, through the recuperator 16, through the condenser 18, and to the reservoir 20. The pump 26 may be a high pressure pump that is driven by a motor (not shown) to effectively control the flow characteristics of the working fluid flowing into the heat exchanger 30. For example, the pump 26 can be driven by the motor to provide precise and accurate control of the speed, volume and/or pressure of the working fluid entering the heat exchanger 30. In this regard, as will be described in more detail below, the system control module 24 may modulate or otherwise control the operation of the pump 26, and therefore the flow characteristics of the working fluid entering the heat exchanger 30, through wired or wireless communication with the pump 26.

The valve 28 may be disposed between, and thus in fluid communication with, the pump 26 and the heat exchanger 30. The valve 28 may be a shut-off type valve, such that the valve 28 can effectively control the flow characteristics of the working fluid entering the heat exchanger 30. In particular, the valve 28 may be adjustable between a fully-open position, a fully-closed position, and intermediate positions between the fully-open and fully-closed positions. For example, the valve 28 can be fully-closed to prevent fluid communication between the pump 26 and the heat exchanger 30. In this regard, as will be described in more detail below, the system control module 24 may control the valve 28, and therefore the flow characteristics of the working fluid entering the heat exchanger 30, through wired or wireless communication with the valve 28.

The heat exchanger 30 may be disposed between, and thus in fluid communication with, the valve 28 and the expander 14. In this regard, as discussed above, working fluid may enter each respective heat exchanger 30 from the respective valve 28, and thereafter flow from each respective heat exchanger 30 to the expander 14. Each respective heat exchanger 30 may communicate with a respective boiler or heat source 34 via a heat path 36. For example, the first heat exchanger 30*a* may communicate with a first heat source 34*a* via a first heat path 36*a*, the second heat exchanger 30*b* may communicate with a second heat source 34*b* via a second heat path 36*b*, and any number of other heat exchangers 30*n* may communicate with any number of other heat sources 34*n* via heat paths 36*n*. As will be discussed in more detail below, the heat sources 34 may include any form of a heat producing process, such as nuclear power, fossil fuel combustion, or processes for producing heat. In one configuration, the heat source 34 may include waste heat from the engine 11. For example, the first heat source 34*a* may include or otherwise fluidly communicate exhaust gases produced by the engine 11. In this regard, the first heat path 36*a* may fluidly communicate with a portion of an exhaust system (not shown) of the vehicle. The second heat source 34*b* and the other number of heat sources 34*n* may include or otherwise fluidly communicate exhaust gases produced by the engine 11, or fluidly communicate other forms of heat produced or otherwise disposed of from other portions of the engine 11.

The expander 14 may be located downstream of the heat exchanger systems 12 and upsteam of the recuperator 16. In this regard, as illustrated in FIG. 1, the expander 14 may be disposed between, and in fluid communication with, the heat exhangers 30 and the recuperator 16. The expander 14 may include various configurations of a turbine having an output shaft 40. Fluid communication of the working fluid from the heat exchangers 30 to the expander 14 can cause the output shaft 40 to rotate and thereby assist with the rotation of the crankshaft 27 of the engine 11. For example, the output shaft 40 may be coupled to the crankshaft 27 of the engine 11 via a transmission device (not shown) that transmits rotary power from the output shaft 40 to the crankshaft 27. The transmission device may include a belt and pulleys, a chain and sprockets, a system of gears, hydraulic lines and pistons, an electric variable transmission, a clutch and/or any other device or system capable of transferring rotary power from the output shaft 40 to the crankshaft 27.

The recuperator 16 may be located downstream of the expander 14 and upstream of the condenser 18. The recuperator 16 may also be located downstream of the lift pump 22 and upstream of the heat exchanger systems 12. In this regard, as illustrated in FIG. 1, the recuperator 16 may be disposed between, and in fluid communication with, the expander 14 and the condenser 18, and further disposed between, and in fluid communication with, the lift pump 22 and the pumps 26. As will be explained in more detail below, as the working fluid passes through the recuperator 16 from the expander 14, it may be cooled in the recuperator 16 prior to flowing to the condenser 18. As the working fluid passes through the recuperator 16 from the lift pump 22, it may be heated in the recuperator 16 prior to flowing to the pumps 26. In this regard, working fluid flowing into the recuperator 16 from the expander 14 may transfer heat to, and thus increase the temperature of, working fluid flowing into the recuperator 16 from the lift pump 22 prior to the working fluid flowing into the heat exchanger systems 12 from the recuperator.

The condenser 18 may be located downstream of the recuperator 16 and upstream of the working fluid reservoir 20. In this regard, as illustrated, the condenser 18 may be disposed between, and in fluid communication with, the recuperator 16 and upstream of the working fluid reservoir 20. As will be explained in more detail below, as the working fluid passes through the condenser 18 from the recuperator 16, it may be further cooled via various forms of heat exchange, such as a fin-and-tube type heat exchanger, for example.

The working fluid reservoir 20 may be located downstream of the condenser 18 and upstream of the lift pump 22. In this regard, as illustrated, the working fluid reservoir 20 may be disposed between, and in fluid communication with, the condenser 18 and the lift pump 22. The working fluid reservoir 20 can include various forms of a holding tank or other suitable device for storing a volume of the working fluid. In particular, the working fluid reservoir 20 can be configured to store a volume of the working fluid at atmospheric pressure. For example, the working fluid reservoir 20 may store the working fluid at atmospheric pressure when the system 10 is not operating.

The lift pump 22 may be located downstream of the working fluid reservoir 20 and upstream of the recuperator 16. In this regard, as illustrated, the lift pump 22 may be disposed between, and in fluid communication with, the fluid reservoir 20 and the recuperator 16. As will be explained in more detail below, the lift pumps 22 can cause the working fluid to flow through the recuperator 16 to the pumps 26.

Figure 2:
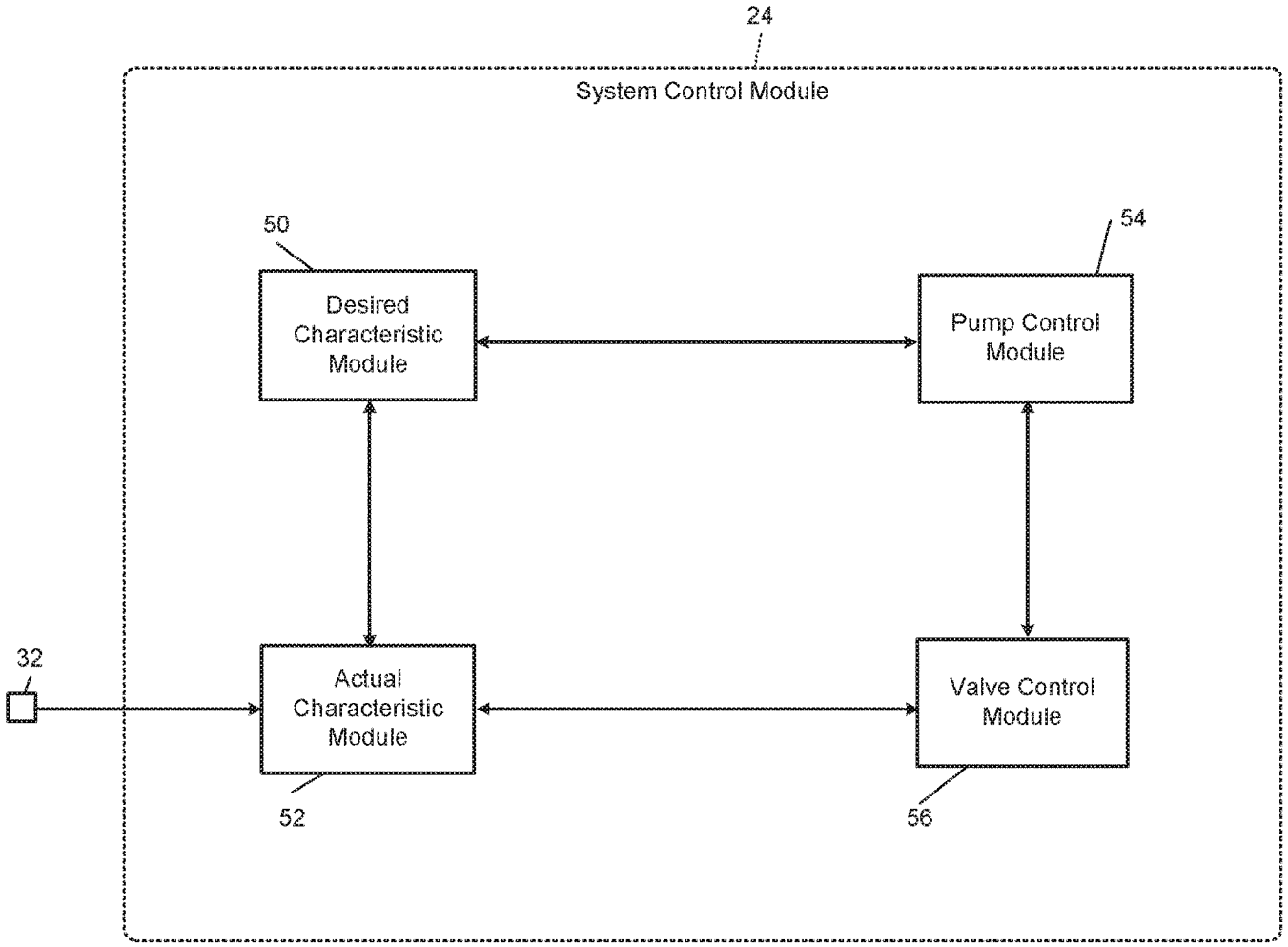
FIG. 2 is a functional block diagram of an example control system according to the principles of the present disclosure.

With reference to FIG. 2, an example implementation of the system control module 24 includes a desired characteristic module 50, an actual characteristic module 52, a pump control module 54, and a valve control module 56. The desired characteristic module 50 determines a desired value of one or more characteristics of the working fluid flowing through the flowpath 25. In some configurations, the desired characteristic module 50 may determine the desired value of the characteristic(s) based on one or more operating parameters of the engine 11. The actual characteristic module 52 determines an actual value of the characteristic(s) of the working fluid flowing through the flowpath 25. In some configurations, the actual characteristic module 52 may determine an actual value of the characteristic(s) of the working fluid flowing through one or more of the heat exchanger systems 12. For example, the actual characteristic module 52 may receive the actual value of the characteristic(s) from the sensor(s) 32.

The pump control module 54 and the valve control module 56 may communicate with the pump(s) 26 and the valve(s) 28, respectively, to control the flow of working fluid through one or more of the heat exchanger systems 12. In this regard, as will be explained in more detail below, the pump control module 54 and the valve control module 56 may communicate with the pump(s) 26 and the valve(s) 28 to increase or decrease the actual value of the characteristic(s) of the working fluid flowing through the heat exchanger system(s) 12 and the flowpath 25.

Figure 3:
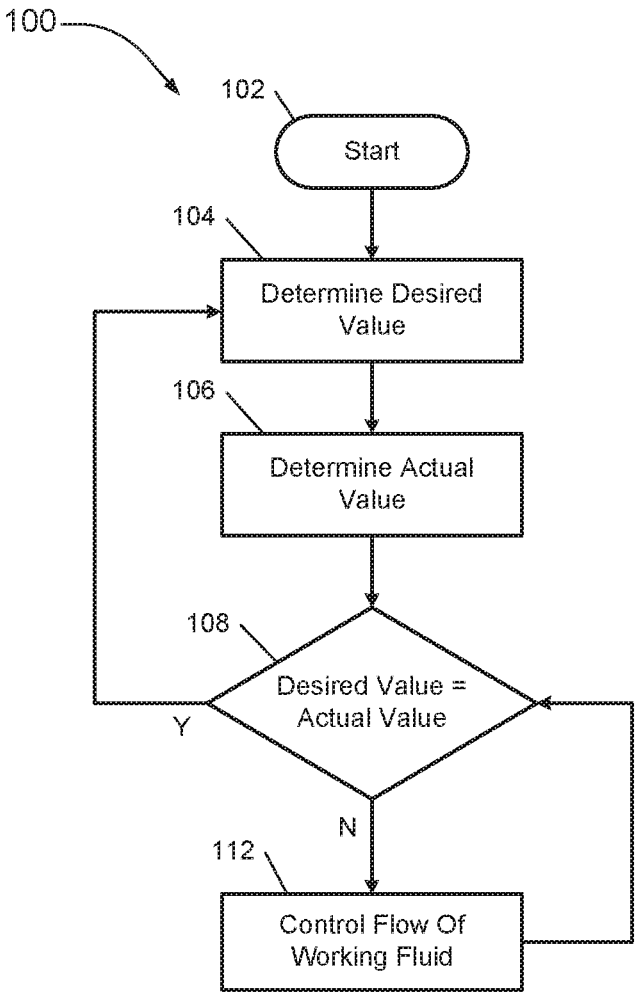
FIG. 3 is a flowchart illustrating an example control method according to the principles of the present disclosure.

With reference to FIG. 3, a method 100 of controlling or otherwise operating the Rankine cycle system 10 having "n" heat exchanger systems 12 begins at 102. The method is described in the context of the modules of FIG. 2. However, the particular modules that perform the steps of the method may be different than the modules mentioned below and/or the method may be implemented apart from the modules of FIG. 2

At 104, the desired characteristics module 50 determines an acceptable or desired value of one or more characteristics (e.g., volumetric or mass flow rate, temperature, pressure) of the working fluid flowing through one or more of the flowpath 25 and/or the heat exchanger systems 12. The desired values of the characteristic(s) can be calculated, or otherwise determined, based on various operating parameters of the engine 11. For example, in some scenarios, the heat exchanger **30*n* may absorb a minimum amount of heat or energy from the heat source 34*n* in order to ensure that the system 10, including the expander 14, is not damaged. In these scenarios, the desired values may include a desired mass flow rate, for example, of working fluid that will absorb the minimum amount of heat from the working fluid. The desired characteristics module 50** outputs the desired values of the characteristics.

At 106, the actual characteristics module 52 determines actual values of the one or more characteristic(s) (e.g., volumetric or mass flow rate, temperature, pressure) of the working fluid flowing through each of the boilers or heat exchangers **30*n*. For example, in some configurations the actual values of the characteristic(s) can be measured or otherwise determined by the sensor(s) 32, and the actual characteristics module 52 may receive the actual values from the sensors 32. In other configurations, the actual characteristics module 52 may calculate the actual values of the characteristic(s) based on measurements provided by the sensor(s) 32. For example, the actual values may be communicated to and/or otherwise stored in the system control module 24**.

Once the actual and desired value(s) of the flow characteristics of the working fluid have been calculated or otherwise determined for each heat exchanger system **12*n*, at 108 the system control module 24 compares the actual value for each heat exchanger system 12*n* to the desired value for the respective heat exchanger system 12*n*. Specifically, at 108 the system control module 24** determines whether the actual value is equal to, or within a predetermined range of, the desired value.

If the system control module 24 determines that the actual value equals the desired value, the method 100 may return to 104. If the system control module 24 determines that the actual value does not equal, or is outside of the predetermined range of, the desired value, the method 100 may proceed to 112 where the pump control module 54 and/or the valve control module 56 may adjust the flow of working fluid through one or more of the heat exchanger systems 12*n*. For example, the pump control module 54 and/or the valve control module 56 may adjust the flow of working fluid to minimize a difference between the actual value and the desired value.

In particular, if the actual value is less than the desired value, at 112 the pump control module 54 may communicate with the respective pump 26*n* to change (e.g., increase) the speed of the pump 26*n*, and thus increase the actual value of the characteristic. In some scenarios, if the actual value is less than the desired value, at 112 the valve control module 56 may communicate with, and open, one or more of the valves 28*n* to increase the flow of working fluid through one or more of the heat exchanger systems 12*n*.

Conversely, if the actual value is greater than the desired value, at 112 the pump control module 54 may communicate with the respective pump 26*n* to change (e.g., decrease) the speed of the pump 26*n*, and thus reduce the actual value of the characteristic. In some scenarios, if the actual value is greater than the desired value, at 112 the valve control module 56 may communicate with, and close, one or more of the valves 28*n* to decrease and/or terminate the flow of working fluid through one or more of the heat exchanger systems 12*n*. For example, if a leak is detected in the portion of the flowpath 25 that extends through the heat exchanger system 12*n*, or if the portion of the flowpath 25 that extends through the heat exchanger system 12*n* otherwise requires service or special operating conditions, at 112 the pump control module 54 may terminate the flow of working fluid through the particular heat exchanger system 12*n*. In this regard, it will be appreciated that the system 10 may include one or more sensors (not shown) for detecting leaks or other special operating conditions that indicate a need for servicing one or more of the heat exchanger systems 12*n*.

While the flow of working fluid is terminated through the particular heat exchanger system 12*n*, working fluid may continue flowing through other(s) of the heat exchanger system(s) 12*n* that do not include a leak or other special operating conditions that might otherwise require service. Once the pump control module 54 and/or valve control module 56 has controlled the respective pump 26*n* and/or valve 28*n* at 112, the method 100 may return to 104.

The Rankine cycle system 10, and the method of operating the heat exchanger systems 12, can help to ensure that the system 10 and the engine 11 operate efficiently and in a way that does not damage the system 10. In particular, by providing a parallel configuration of more than one heat exchanger system 12, including the pump 26 and the valve 28 corresponding to each respective heat exchanger system 12, the Rankine cycle system 10 provides a cost-effective system and method for precisely controlling the pressure of the working fluid entering the heat exchangers 30.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term 'module' or the term 'controller' may be replaced with the term 'circuit.' The term 'module' may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium include nonvolatile memory circuits (such as a flash memory circuit or a mask read-only memory circuit), volatile memory circuits (such as a static random access memory circuit and a dynamic random access memory circuit), and secondary storage, such as magnetic storage (such as magnetic tape or hard disk drive) and optical storage.

The apparatuses and methods described in this application may be partially or fully implemented by a special purpose computer created by configuring a general purpose computer to execute one or more particular functions embodied in computer programs. The computer programs include processor-executable instructions that are stored on at least one non-transitory, tangible computer-readable medium. The computer programs may also include or rely on stored data. The computer programs may include a basic input/output system (BIOS) that interacts with hardware of the special purpose computer, device drivers that interact with particular devices of the special purpose computer, one or more operating systems, user applications, background services and applications, etc.

The computer programs may include: (i) assembly code; (ii) object code generated from source code by a compiler; (iii) source code for execution by an interpreter; (iv) source code for compilation and execution by a just-in-time compiler, (v) descriptive text for parsing, such as HTML (hypertext markup language) or XML (extensible markup language), etc. As examples only, source code may be written in C, C++, C#, Objective-C, Haskell, Go, SQL, Lisp, Java®, ASP, Perl, Javascript®, HTML5, Ada, ASP (active server pages), Perl, Scala, Erlang, Ruby, Flash®, Visual Basic®, Lua, or Python®.

None of the elements recited in the claims is intended to be a means-plus-function element within the meaning of 35 U.S.C. § 112(f) unless an element is expressly recited using the phrase "means for", or in the case of a method claim using the phrases "operation for" or "step for".

What is claimed is:

1. A waste heat recovery system for an engine, the waste heat recovery system comprising:

an expander configured to convert waste heat from a working fluid into mechanical energy;

a first heat exchanger system in fluid communication with the expander, wherein the first heat exchanger system is disposed upstream of the expander, and wherein the first heat exchanger system comprises a first pump, a first control valve, and a first heat exchanger;

a second heat exchanger system in fluid communication with the expander, wherein the second heat exchanger system is disposed upstream of the expander and arranged in parallel with the first heat exchanger system, and wherein the second heat exchanger system comprises a second pump, a second control valve, and a second heat exchanger;

a desired characteristic module that;

determines a first desired value of a flow characteristic of the working fluid flowing through the first heat exchanger system, and independent of determining the first desired value, determines a second desired value of the flow characteristic of the working fluid flowing through the second exchanger system; and a control module that:

controls at least one of the first control valve and the first pump to adjust the flow of the working fluid through the first heat exchanger system based on the first desired value, and controls at least one of the second control valve and the second pump to adjust the flow of working fluid through the second heat exchanger system based on the second desired value.

2. The waste heat recovery system of claim 1, further comprising:

a condenser disposed downstream of the expander and upstream of the first and second heat exchanger systems; and a recuperator having a hot side disposed upstream of the condenser and a cold side disposed downstream of the condenser and upstream of the first and second heat exchanger systems.

3. The waste heat recovery system of claim 2, further comprising a third pump disposed downstream of the condenser and upstream of the cold side of the recuperator.

4. The waste heat recovery system of claim 3, wherein:

the first and second pumps are each disposed downstream of the cold side of the recuperator, the first and second heat exchangers are each disposed upstream of the expander, the first heat exchanger is disposed downstream of the first pump, and the second heat exchanger is disposed downstream of the second pump.

5. The waste heat recovery system of claim 4, wherein the first control value is disposed downstream of the first pump and upstream of the first heat exchanger, and the second control valve is disposed downstream of the second pump and upstream of the second heat exchanger.

6. The waste heat recovery system of claim 1, further comprising the engine, wherein the engine is in fluid communication with the first and second heat exchanger systems.

7. The waste heat recovery system of claim 1, wherein the first heat exchanger system includes a first heat exchanger in fluid communication with a first heat source, and the second heat exchanger system includes a second heat exchanger in fluid communication with a second heat source.

8. The waste heat recovery system of claim 7, wherein the first and second heat sources include exhaust gas from the engine.

9. The waste heat recovery system of claim 1, wherein the second desired value is different than the first desired value.

10. A method of operating a waste heat recovery system having first and second heat exchanger systems arranged in parallel with one another and in fluid communication with an expander, the method comprising:

determining a first actual value of a flow characteristic of a working fluid flowing through the first heat exchanger system;

determining a second actual value of the flow characteristic of the working fluid flowing through the second heat exchanger system;

determining a first desired value of the flow characteristic of the working fluid flowing through the first heat exchanger system;

independent of determining the first desired value, determining a second desired value of the flow characteristic of the working fluid flowing through the second heat exchanger system;

comparing the first actual value of the flow characteristic to the first desired value of the flow characteristic;

comparing the second actual value of the flow characteristic to the second desired value of the flow characteristic; and adjusting at least one of a pump speed and a valve position based on at least one of the comparison of the first actual value of the flow characteristic to the first desired value of the flow characteristic and the comparison of the second actual value of the flow characteristic to the second desired value of the flow characteristic.

11. The method of claim 10, wherein the first heat exchanger system includes a first pump and the second heat exchanger system includes a second pump, and wherein adjusting at least one of the pump speed and the valve position includes adjusting the speed of at least one of the first and second pumps.

12. The method of claim 10, wherein the first heat exchanger system includes a first control valve and the second heat exchanger system includes a second control valve, and wherein adjusting at least one of the pump speed and the valve position includes closing at least one of the first and second control valves.

13. The method of claim 10, wherein the second desired value is different than the first desired value.

14. A system comprising:

a desired characteristic module that:

determines a first desired value of a flow characteristic of a working fluid flowing through a first heat exchanger system of a Rankine cycle system; and independent of determining the first desired value, determines a second desired value of the flow characteristic of the working fluid flowing through a second heat exchanger system of the Rankine cycle system, wherein the second heat exchanger system is arranged in parallel with the first heat exchanger system; and at least one of:

a pump control module that:

based on the first desired value, selectively changes the speed of a first pump disposed in the first heat exchanger system; and based on the second desired value, selectively changes the speed of a second pump disposed in the second heat exchanger system; and a valve control module that:

based on the first desired value, selectively adjusts the position of a first valve disposed in the first heat exchanger system; and based on the second desired value, selectively adjusts the position of a second valve disposed in the second heat exchanger system.

15. The system of claim 14, wherein the flow characteristic includes a flow rate of the working fluid, a temperature of the working fluid, and a pressure of the working fluid.

16. The system of claim 14, wherein the pump control module:

decreases the speed of the first pump when an actual value of the flow characteristic of the working fluid flowing through the first heat exchanger system is greater than the first desired value of the flow characteristic;

decreases the speed of the second pump when an actual value of the flow characteristic of the working fluid flowing through the second heat exchanger system is greater than the second desired value of the flow characteristic;

increases the speed of the first pump when the actual value of the flow characteristic of the working fluid flowing through the first heat exchanger system is less than the first desired value of the flow characteristic; and increases the speed of the second pump when the actual value of the flow characteristic of the working fluid flowing through the second heat exchanger system is less than the second desired value of the flow characteristic.

17. The system of claim 14, wherein the valve control module:

closes the first valve when an actual value of the flow characteristic of the working fluid flowing through the first heat exchanger system is greater than the first desired value of the flow characteristic;

closes the second valve when an actual value of the flow characteristic of the working fluid flowing through the second heat exchanger system is greater than the second desired value of the flow characteristic;

opens the first valve when the actual value of the flow characteristic of the working fluid flowing through the first heat exchanger system is less than the first desired value of the flow characteristic; and opens the second valve when the actual value of the flow characteristic of the working fluid flowing through the second heat exchanger system is less than the second desired value of the flow characteristic.

18. The system of claim 14, wherein the pump control module independently controls the first and second pumps based on the first and second desired values, respectively.

19. The system of claim 14, wherein the valve control module independently controls the first and second valves based on the first and second desired values, respectively.

20. The system of claim 14, wherein the second desired value is different than the first desired value.

* * * * *